US010827267B2

(12) United States Patent
Liu

(10) Patent No.: US 10,827,267 B2
(45) Date of Patent: Nov. 3, 2020

(54) SOUND DEVICE AND ELECTRONIC DEVICE USING SOUND DEVICE

(71) Applicant: AAC Technologies Pte. Ltd., Singapore (SG)

(72) Inventor: Xiaodong Liu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/702,601

(22) Filed: Dec. 4, 2019

(65) Prior Publication Data

US 2020/0204918 A1 Jun. 25, 2020

(30) Foreign Application Priority Data

Dec. 25, 2018 (CN) ..... 2018 1 1587782

(51) Int. Cl.
*H04R 5/02* (2006.01)
*H04R 1/02* (2006.01)

(52) U.S. Cl.
CPC ..... *H04R 5/02* (2013.01); *H04R 1/025* (2013.01); *H04R 2499/11* (2013.01)

(58) Field of Classification Search
CPC combination set(s) only.
See application file for complete search history.

(56) References Cited

U.S. PATENT DOCUMENTS 9,154,865 B2 * 10/2015 Zha ..... H04R 1/021
9,820,034 B1 * 11/2017 Zhang ..... H04R 1/025

* cited by examiner

*Primary Examiner* — Phung-Hoang J Nguyen
(74) *Attorney, Agent, or Firm* — W&G Law Group LLP

(57) ABSTRACT

The present invention provides a sound device and an electronic device using the sound device. The sound device includes a housing with an accommodating space, a sound unit accommodated in the housing and a control device arranged outside the housing. The sound unit divides the accommodating space into a front cavity and a rear cavity, and a through hole is arranged in a position of the housing corresponding to the rear cavity. The control device includes a sealing member sealing the through hole. When the control device presses the sealing member against the housing and the through hole is sealed by the sealing member, the sound device is in a first sound mode. When the control device disengages the sealing member from the housing and the through hole is not sealed by the sealing member, the sound device is in a second sound mode.

4 Claims, 3 Drawing Sheets

SOUND DEVICE AND ELECTRONIC DEVICE USING SOUND DEVICE

TECHNICAL FIELD

The present invention relates to electroacoustic device, and more particularly, to a sound device and an electronic device using the sound device.

BACKGROUND

With an increasing application of stereo in mobile phones and other electronic devices, a receiver at the top of the mobile phone is required to have the function of a speaker so that the receiver may cooperate with the speaker at the bottom of the mobile phone to form stereo. However, the receiver and the speaker have different requirements on a cavity which cannot be implemented at the same time, so there must be a choice between the receiver and the speaker in terms of design.

Therefore, it is necessary to provide a new sound device.

DETAILED DESCRIPTION

In order to better understand solutions of the present invention and advantages thereof in various aspects, the present invention will be described in further detail below with reference to drawings through specific embodiments. In addition, the following specific embodiments are provided to facilitate a clearer and more thorough understanding of contents of the present invention, rather than limit the present invention.

Figure 1:
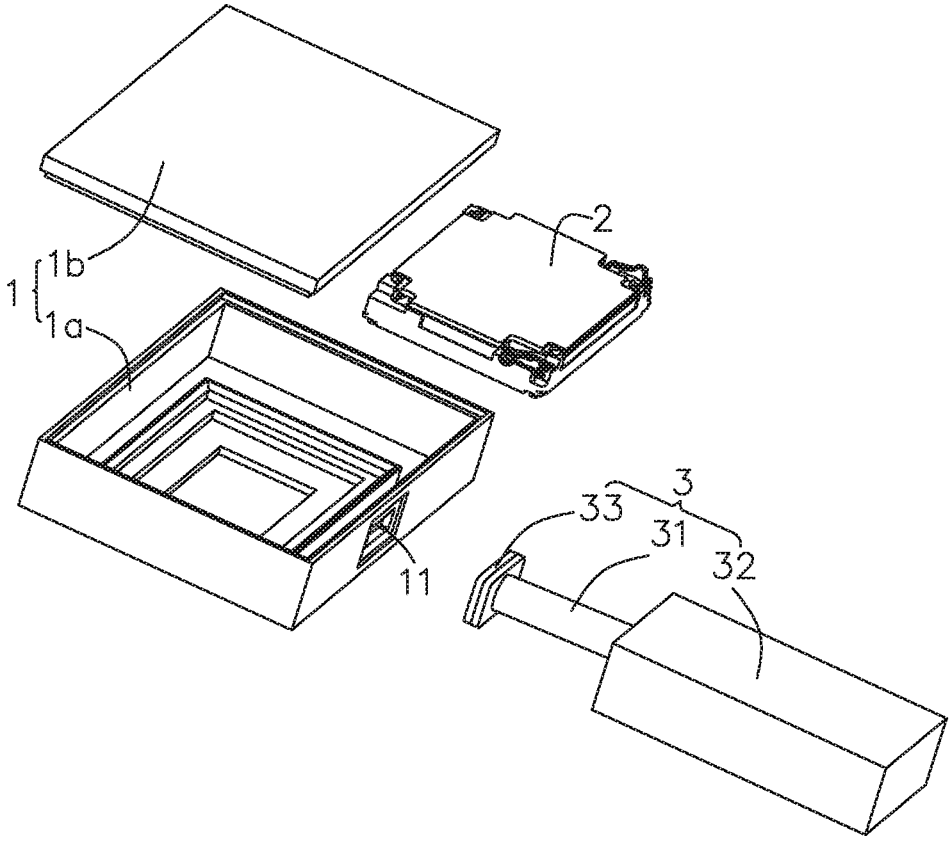
FIG. 1 is a perspective exploded view of a sound device according to the present invention.
Figure 2:
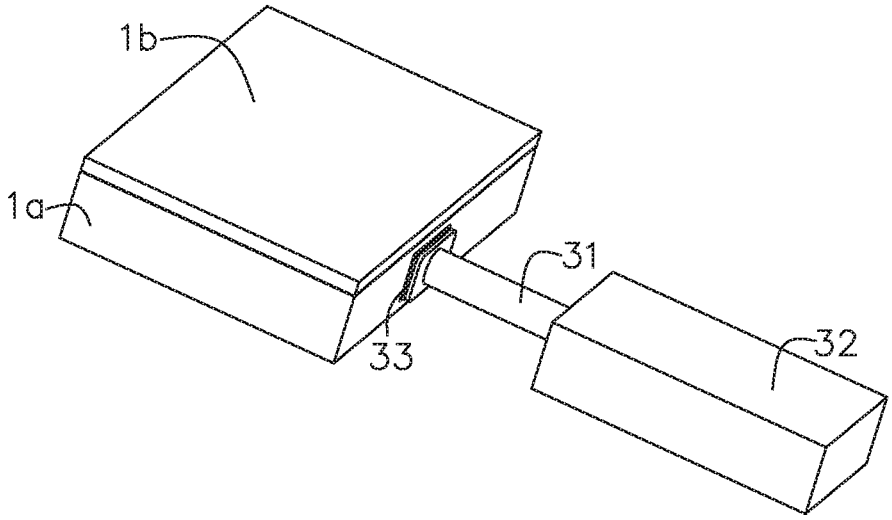
FIG. 2 is a schematic perspective view of the sound device according to the present invention.
Figure 3:
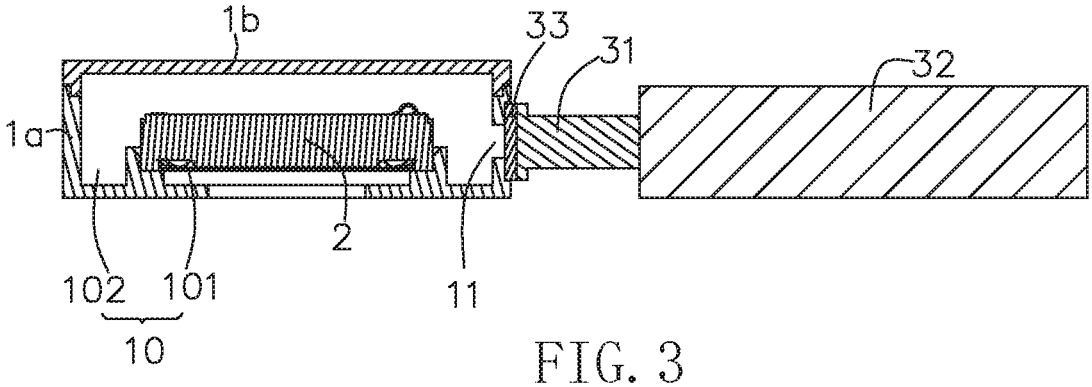
FIG. 3 is a sectional view of the sound device in a first sound mode according to the present invention.
Figure 4:
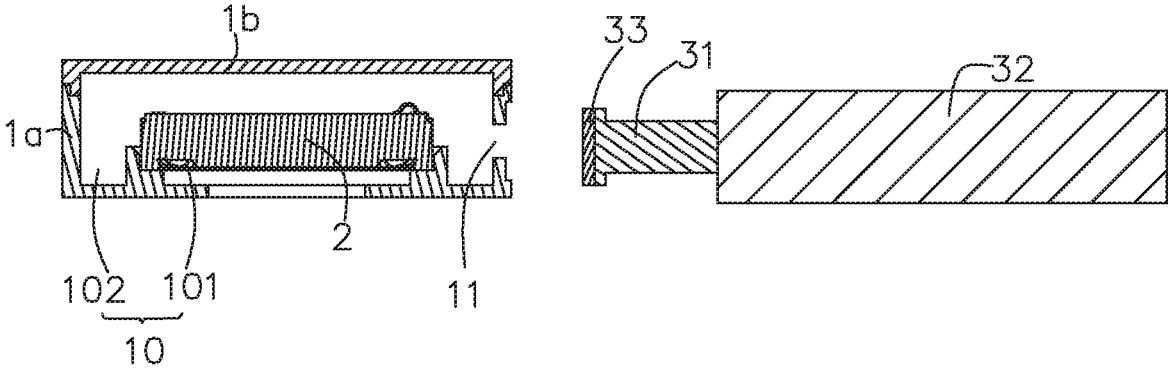
FIG. 4 is a sectional view of the sound device in a second sound mode according to the present invention.

As shown in FIG. 1 to FIG. 4, the present invention provides a sound device, which includes a housing 1 with an accommodating space 10, a sound unit 2 accommodated in the housing 1 and a control device 3 arranged outside the housing 1.

The sound unit 2 divides the accommodating space 10 into a front cavity 101 and a rear cavity 102, and a through hole 11 is arranged in a position of the housing 1 corresponding to the rear cavity 102.

In this embodiment, the housing 1 includes a top cover 1*a* and a lower cover 1*b* covered on and connected to the top cover 1*a*. The sound unit 2 and the top cover 1*a* define the front cavity 101. The sound unit 2, the top cover 1*a* and the lower cover 1*b* define the rear cavity 102 together. The through hole 11 is formed in the top cover 1*a*.

The control device 3 includes a transmission rod 31, a motor 32 controlling the transmission rod 31 to extend and retract, and a sealing member 33 arranged at a tail end of the transmission rod 31. The sealing member 33 is preferably made of foam.

The sound device in the present invention has two sound modes.

When the control device 3 presses the sealing member 33 against the housing 1 (the top cover 1*a* in this embodiment) and the through hole 11 is sealed by the sealing member 33, the sound device is in a first sound mode. A specific operation may be that the motor 32 drives the transmission rod 31 to extend, the transmission rod 31 presses the foam 33 at the tail end of the transmission rod 31 against the housing 1, and the foam 33 is compressed and seals the through hole 11. Of course, the sealing member 33 may be made of silica gel in addition to foam. In fact, as long as the transmission rod 31 presses against the housing 1, the sealing member 33 may be made of any material that can seal the through hole 11. In addition, the control device 3 is not limited to a combination of the transmission rod 31 and the motor 32, as long as the control device is a mechanical structure capable of driving the sealing member 33.

When the control device 3 disengages the sealing member 33 from the housing 1 and the through hole 11 is not sealed by the sealing member 33, the sound device is in a second sound mode. A specific operation may be that the motor 32 drives the transmission rod 31 to retract, and the transmission rod 31 disengages the sealing member 33 at the tail end of the transmission rod 31 from the housing 1. Of course, the case that the sealing member 33 is originally disengaged from the housing 1 is also included, as long as the through hole 11 is not sealed by the sealing member 33.

When the sound device in the present invention is applied to an electronic device (such as a mobile phone, a tablet computer and other devices using the sound device), the sound mode of the sound device is selected according to different sound requirements of the electronic device. When the sound device is in the first sound mode, at this time, the sound unit 2 only uses the rear cavity 102 in the housing 1, and $F_0$ of the sound unit 2 is increased, which can provide a higher product pressurization and a better medium-high frequency effect, and optimize a sound effect of a speaker of the sound device, thus implementing a stereo function of the electronic device, and avoiding a housing vibration problem in the sound mode. When the sound device is in the second sound mode, at this time, the rear cavity 102 in the housing 1 is communicated with an internal cavity of the electronic device, so that the internal cavity of the electronic device can be fully utilized to provide a larger rear cavity for the sound unit 2, and the $F_0$ of the sound unit 2 is reduced, which can provide a better low-frequency effect, and optimize a sound effect of a receiver of the sound device.

It should be noted that those ordinary skills in the art may make various modifications and changes without departing from the inventive concept of the present invention, and these modifications and changes shall all fall within the scope of protection of the present invention.

What is claimed is:

1. A sound device, comprising a housing with an accommodating space, a sound unit accommodated in the housing and a control device arranged outside the housing, wherein the sound unit divides the accommodating space into a front cavity and a rear cavity, a through hole is arranged in a position of the housing corresponding to the rear cavity, and the control device comprises a transmission rod, a motor controlling the transmission rod to extend and retract, and a sealing member arranged at a tail end of the transmission rod, wherein:

when the control device presses the sealing member against the housing and the through hole is sealed by the sealing member, the sound device is in a first sound mode; and when the control device disengages the sealing member from the housing and the through hole is not sealed by the sealing member, the sound device is in a second sound mode.

2. The sound device according to claim 1, wherein the sealing member is made of foam.

3. An electronic device, comprising a sound device, wherein the sound device comprises a housing with an accommodating space, a sound unit accommodated in the housing and a control device arranged outside the housing, wherein the sound unit divides the accommodating space into a front cavity and a rear cavity, a through hole is arranged in a position of the housing corresponding to the rear cavity, and the control device comprises a transmission rod, a motor controlling the transmission rod to extend and retract, and a sealing member arranged at a tail end of the transmission rod, wherein:

when the control device presses the sealing member against the housing and the through hole is sealed by the sealing member, the sound device is in a first sound mode; and when the control device disengages the sealing member from the housing and the through hole is not sealed by the sealing member, the sound device is in a second sound mode.

4. The electronic device according to claim 3, wherein the sealing member is made of foam.

* * * * *